US005567929A

United States Patent [19]

Ouimette

[11] Patent Number: 5,567,929

[45] Date of Patent: Oct. 22, 1996

[54] FLAT PANEL DETECTOR AND IMAGE SENSOR

[75] Inventor: Donald R. Ouimette, Plantsville, Conn.

[73] Assignee: University of Connecticut, Farmington, Conn.

[21] Appl. No.: 391,709

[22] Filed: Feb. 21, 1995

[51] Int. Cl.[6] ..... H01J 40/14

[52] U.S. Cl. ..... 250/214 VT; 250/207; 313/531

[58] Field of Search ..... 250/207, 214 VT; 313/523, 531

[56] References Cited

U.S. PATENT DOCUMENTS 5,369,268 11/1994 Van Aller et al. ..... 250/214 VT

*Primary Examiner*—Stephone Allen

*Attorney, Agent, or Firm*—Herbert M. Shapiro

[57] ABSTRACT

A flat panel image sensor is provided by combining the photoconductive imaging electrode of a vidicon with a two dimensional array of cold cathode field emitters commonly used for flat panel Field Emission Display (FED) systems. The FED operates normally to emit electrons which are accelerated in prior art displays towards a luminescent phosphor to generate light output proportional to the cathode emission. Rather than accelerating towards a phosphor, electrons, in accordance with the principles of this invention, are accelerated towards a photoconductor layer to replace charge removed from the layer by an incident radiation pattern directed at the photoconductor layer through a layer of transparant, electrically-conducting material which serves as a radiation window. A large area, low cost, small, flat panel sensor is realized. The transparant, electrically-conducting layer may be partitioned to reduce stray capacitance for large area sensors and the partitioned, electrically-conducting layer permits a parallel readout mode of operation.

18 Claims, 3 Drawing Sheets

FLAT PANEL DETECTOR AND IMAGE SENSOR

FIELD OF THE INVENTION

This invention relates to an image sensor and more particularly to a flat panel image sensor.

BACKGROUND OF THE INVENTION

Photoconductor materials are well known in the art and are used in a familiar manner in electronic image sensors. In practice, an image sensor includes a housing which has a window of electrically-conducting material through which radiation enters the housing. A photoconductor layer, typical of such a sensor, is electrically insulating and is exposed to incident radiation through the window.

A vacuum is created within the housing so that the opposite surface of the photoconductor is exposed to a vacuum. In operation, a positive voltage is applied to the conducting layer and the vacuum-side face of the photoconductor, in response, is charged with electrons to a cathode potential which establishes a bias field across the photoconductor.

Once charged, the photoconductor, when exposed to a pattern of radiation, exhibits electron-hole pairs which are swept by the bias field moving electrons to the conducting layer and moving holes to the insulating surface of the photoconductor. When holes reach the insulating surface, they recombine with electrons at that surface in a charge pattern representative of the input radiation. The operation is characteristic of the photoconductive action of the standard vidicon-type image tube.

The charge image, so stored, may be read out, for example, by an electron beam which scans the charge surface as in a vidicon as exemplified by U.S. Pat. No. 5,195,118. As the electron beam replaces the charge, removed from the vacuum-side face of the photoconductor by the radiation exposure, a capacitively-coupled signal is sensed by a preamplifier connected to the electrically conducting layer. Although a scanning beam method works well in such sensors, the inherent drawback to such a system is the physical size necessary for the large vacuum bottle which supports the electron gun and the associated electrodes necessary for the operation of scanning beam devices.

BRIEF DESCRIPTION OF THE INVENTION

In accordance with the principles of this invention, the cold cathode technology used for flat panel Field Emission Display (FED) systems is coupled with the photoconductor layer replacing the electron beam source. Accordingly, a one or a two dimensional array of field emitters is used to emit electrons into a vacuum between the array and a photoconductor layer. The electrons are used to replace the charge removed from the photoconductor by the incident radiation pattern. The replacement of the charge, pixel by pixel, produces a data stream which is sensed by a preamplifier connected to the electrically-conducting layer adjacent to the photoconductor layer. The data, so generated, represents the image of the radiation. The array of emitters operates to charge and read out the charge pattern on the photoconductor layer with low velocity electrons instead of high velocity electrons as is the case with a vidicon. Although the invention herein is applicable to any size sensor, it is particularly applicable to large area X-ray sensitive image sensors.

DETAILED DESCRIPTION OF ILLUSTRATIVE EMBODIMENTS OF THIS INVENTION

Figure 1:
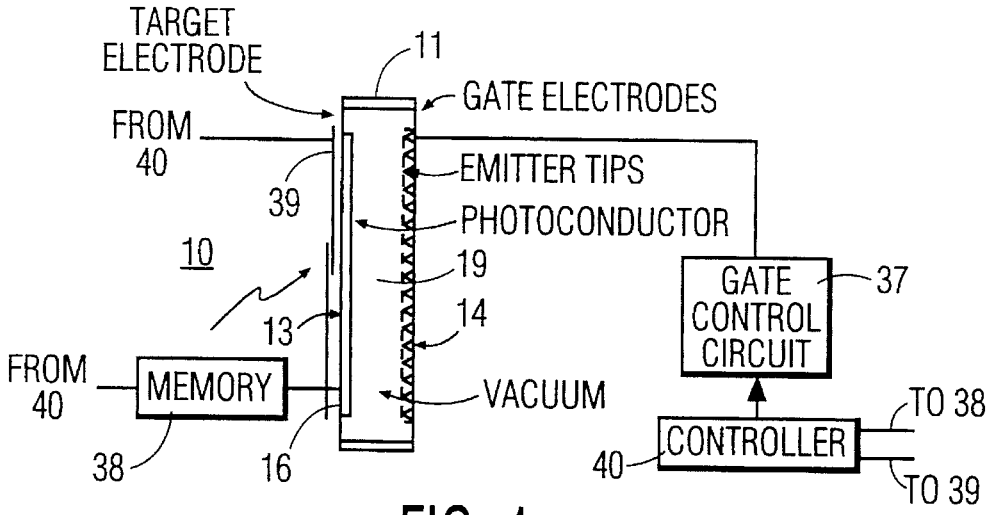
FIG. 1 is a schematic side view of a target electrode coupled with an array of electron emitter tips in accordance with the principles of this invention.

FIG. 1 snows a flat panel sensor 10 in accordance with the principles of this invention, The sensor includes a housing 11 with first and second surfaces 13 and 14, Surface 13 comprises a photoconductor layer 16 with a transparent layer of electrically-conducting material 17 forming a window in the housing. Surface 14 comprises an array of electron beam emitters disposed in a plane parallel to that of surface 13. Electron emitter devices are described, for example, in the "Vacuum Microelectronic Devices", Ivor Brodie and Paul Schnoebel, Proc. IEEE, Vol 82, No. 7, Jul. 1994. The photoconductor layer and the array of electron emitter devices are spaced apart defining a space 19 between them in which a vacuum is maintained.

In operation, a positive voltage is impressed on the photoconductor layer and the vacuum-side face of the layer charges with electrons down to some cathode potential below the target potential. Exposure to a radiation image results in the production of electron-hole pairs. Electrons are swept to the conducting layer (electrode); holes are swept to the vacuum-side face of the photoconductor layer. The holes recombine with electrons at the vacuum-side face resulting in a charge pattern representative of the image.

Figure 2:
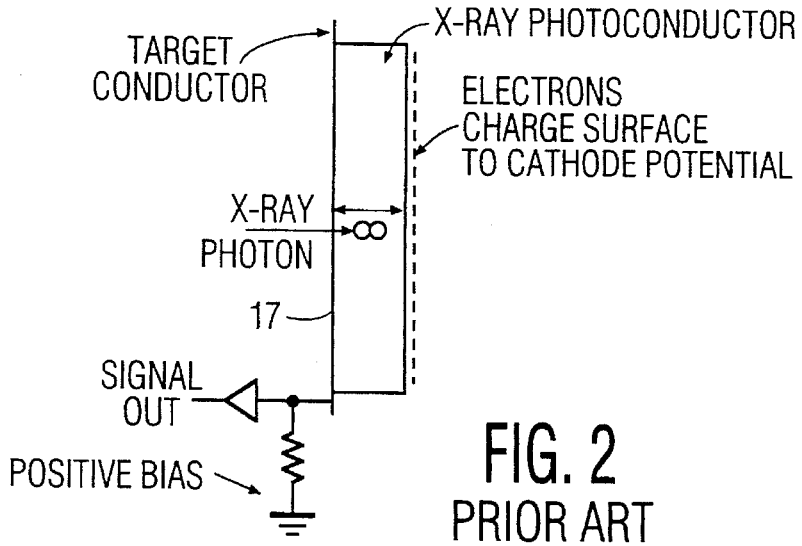
FIG. 2 PRIOR ART
FIG. 2 is an enlarged schematic side view of the target electrode of FIG. 1.

FIG. 2 shows the details of surface 13, illustratively, with incident X-rays. The radiation to which structures of the type shown in FIG. 2 respond is determined by the materials chosen and the voltages applied as is discussed more fully hereinafter. When X-rays or Gamma rays are used, they generate thousands of electron-hole pairs resulting in critical gain for low fluency X-ray exposures.

A window, suitable for use in the flat panel sensor of FIGS. 1 and 2 typically comprises a suitable transparent conductor such as tin oxide or indium tin oxide or a metallic X-ray window such as aluminum or beryllium used to support the photoconductor layer. Typical light sensitive photoconductors include antimony trisulphide lead oxide, amorphous selenium, amorphous silicon, cadmium sulphide, or the compound structures found in Saticon, Newvicon, and Chalnicon type vidicons. For X and gamma ray response, typical photoconductive material may be composed of either thallium bromide (TlBr), thalium iodide (TlI), thalium bromo-iodide, lead iodide,lead bromide, or lead bromoiodide, or selenium. Also, composite sandwiches of any scintillating materials such as cesium iodide or phosphors against a light-sensitive, photoconductive material would also be suitable. The important parameters of the photoconductors are that they must be a high resistivity, insulating material which is photoconductive to the desired energy photons arid provide charge storage. The X and gamma ray sensors must have sufficient gain to amplify the low fluency typical of most x-ray imaging applications. They must also have sufficiently high atomic weight to result in a high absorption efficiency for the X and gamma ray energy desired. All of the specified materials meet these requirements.

Figure 3:
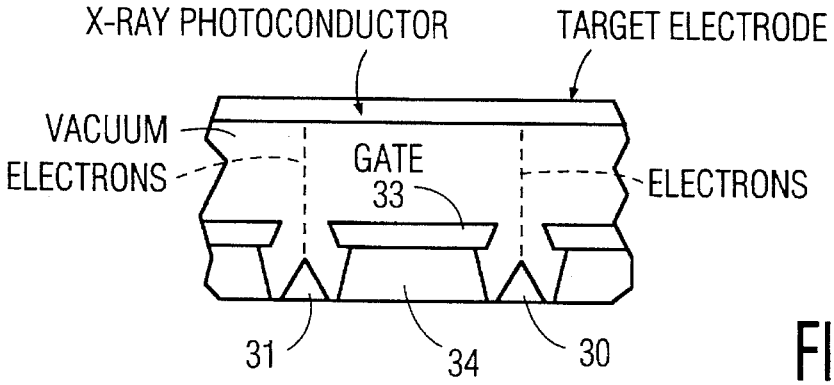
FIG. 3 is an enlarged schematic side view of a flat panel sensor including an array of electron emitter tips with a target electrode of the type shown in FIG. 2.

FIG. 3 shows an enlarged view of an illustrative field emitter tip in the configuration shown in FIG. 1. The emission from each emitter tip (30, 31) is controlled by a gate 33 which is formed on an insulator 34. The gates are individually addressable and can be time sequenced to charge and read out each individual pixel on the photoconductor layer. Groups of pixels also could be binned together, if necessary, to increase the read out speed at a reduced resolution as is done in CCD technology. The signals are sensed at-the target electrode similarly to the manner in which read out is accomplished with a vidicon tube. More complex multiple gate structures can be used also to collimate, focus, and control the electron beams. The gates also may be addressable in groups.

The gates of the emitter tip array are sequenced to direct electrons at areas of the photoconductor layer corresponding to one pixel at a time so that a scan of the entire layer produces a sequence of output data representing the entire image induced in the photoconductor layer by the radiation image. Conveniently, the gates are sequenced in a raster pattern as is common for television tubes.

The control of the activation sequence for the gates is represented by block 37 in FIG. 1 and the memory for storing the data read out from the sensor is represented by block 38 in FIG. 1. The sensor also may include a shutter operative to admit light to the window of a light-sensitive device. The shutter is indicated at 39 in FIG. 1. The activation and timing of the shutter, tip array control and the memory is controlled by a controller 40. These various components may be any such components capable of operating as described. Moreover, various technologies are known for implementing an array of field emitter tips. A sensor in accordance with the principles of this invention can be realized with any such technology. All that is necessary is that each of an array of individually controlled sources of electrons is positioned to direct an electron stream across a vacuum to corresponding pixel positions on the surface of a photoconductor layer.

Figure 4:
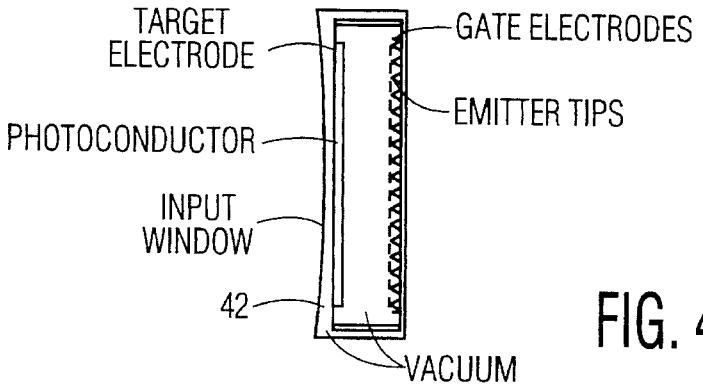
FIGS. 4 and 5 are schematic side views of alternate embodiments of a flat panel sensor of the type shown in FIG. 3.

Also, for very large area sensors, spacers of the type used in flat panel displays may be used to maintain a uniform spacing between the two surfaces of the sensor. For X-ray or Gamma ray applications, the vacuum can be supported by a separate vacuum window indicated at 42 in FIG. 4. The window can be made sufficiently sturdy to withstand the vacuum without the need for spacers and without interfering with the radiation image.

Figure 5:
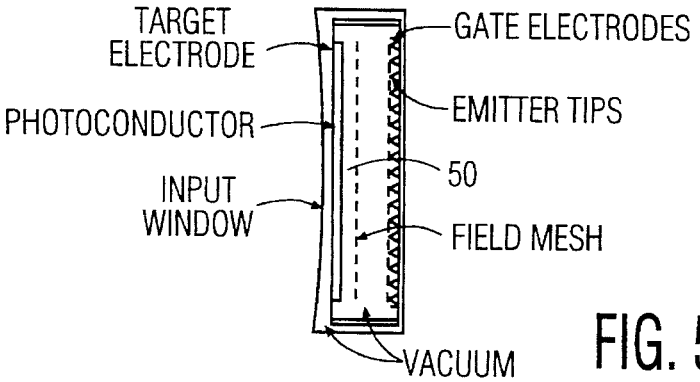

Because of low velocity beam alignment considerations, a separate field mesh may be used as indicated at 50 in FIG. 5. Such meshes are well understood and may be made integral with the gate structure. Typically, a field mesh is used with a more complex gate structure (not shown).

Figure 6:
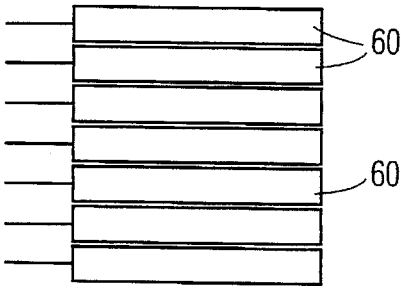
FIG. 6 is a schematic top view of a target electrode for a sensor of the type shown in FIG. 1 with the target electrode partitioned into stripes.

The performance of a flat panel image sensor in accordance with the principles of this invention ultimately may be limited by stray capacitance coupled to the target electrode. FIG. 6 illustrates a flat panel image sensor with the target electrode partitioned into stripes 60 for minimizing the capacitance problem.

Figure 7:
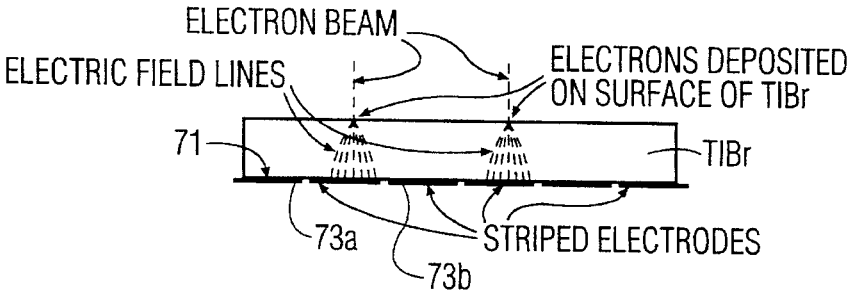
FIG. 7 is a schematic side view of the embodiment of FIG. 6.

Striped electrodes for reducing stray capacitance are known as indicated by U.S. Pat. No. 4,059,840. But partitioned electrodes have a problem which limits the use of such an electrode in sensors of the type disclosed herein. The problem arises when electrons are replaced at the vacuum side surface of the photoconductor layer in the vicinity of a split in the target electrode. FIG. 7 shows a cross sectional view of a vacuum surface 71 of a photoconductor layer with striped electrodes 73*a*, 73*b*, - - - on the bottom, as viewed. When electrons are replaced, as shown, electric field forces from the deposited electrons project out through the photoconductor layer and intersect the target electrode (i.e. capacitance coupling).

This coupling forces a displacement current in the target electrode which is the output signal. The problem arises when an electron beam approaches a split in the target electrode where the capacitance effect intersects adjacent electrodes. The loss of signal or cross coupling makes the standard approach to electrode partitioning impractical for image sensors as described herein. The problem is overcome by changing the read out arrangement.

Figure 8:
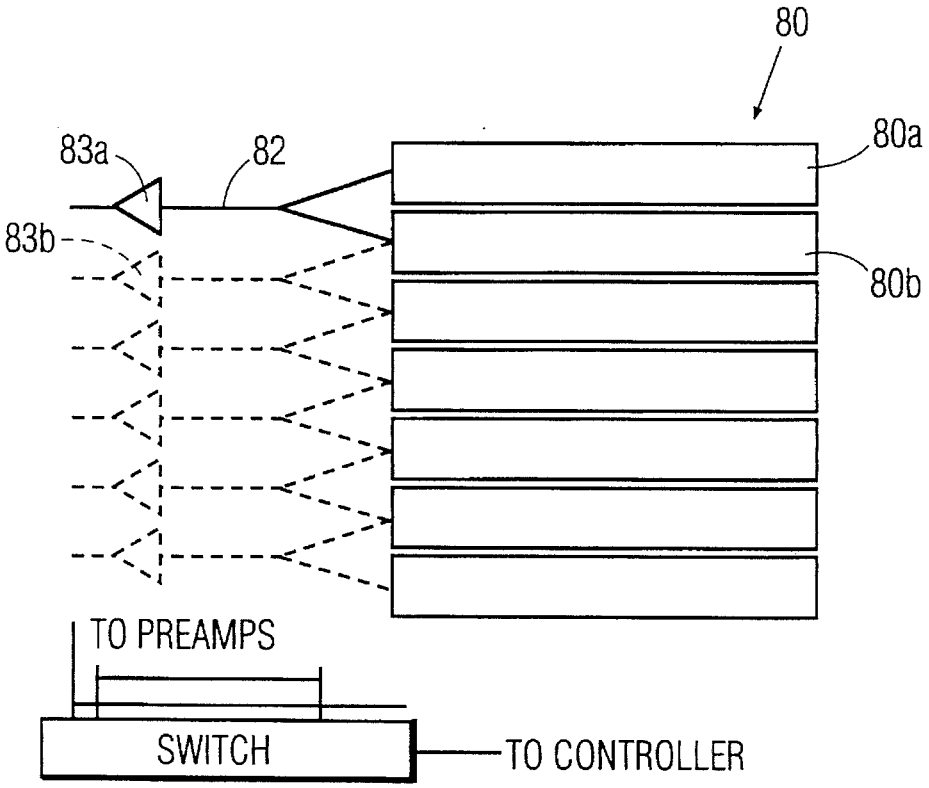
FIGS. 8 and 9 are schematic top views of the embodiment of FIG. 6 showing the electrical read out interconnections.

FIG. 8 illustrates a configuration for reading out data from a flat panel sensor with a partitioned target electrode while avoiding the above-mentioned loss of signal. Specifically, FIG. 8 shows a target electrode 80 with a plurality of stripes 80*a*, 80*b*, - - - . Each stripe is of a width to encompass many scan lines. Each pair of adjacent stripes are connected together electrically as indicated at 82 in FIG. 8. The common connection from each pair of stripes is connected to a preamplifier indicated at 83*a*, 83*b*, - - - .

Electron beam scanning follows the long dimension of the stripe. The scanning proceeds as if the gap between the stripes were not present. Actually, the gap is small typically ½ to ¼ of the beam width. The scan continues half way into the next stripe. At this point, during a retrace or a brief clocking interval, the connection to the first electrode is, in effect, removed and the second and third electrodes are connected together by switching to the next preamplifier (83*b*). Thus, by sequencing the poling of the preamplifiers in this manner, the stripes are always connected in pairs so as the electron beam approaches the gap, the resulting electric field is sensed by both stripes at the preamplifier. This eliminates the practical problem of the stripe configuration and takes advantage of the stray capacitance reduction by whatever pair striping factor is chosen. The paired, partitioned electrode arrangement is applicable to all photoconductive electron beam readout devices but is especially advantageous to large area X-ray sensitive photoconductive sensors.

Figure 9:
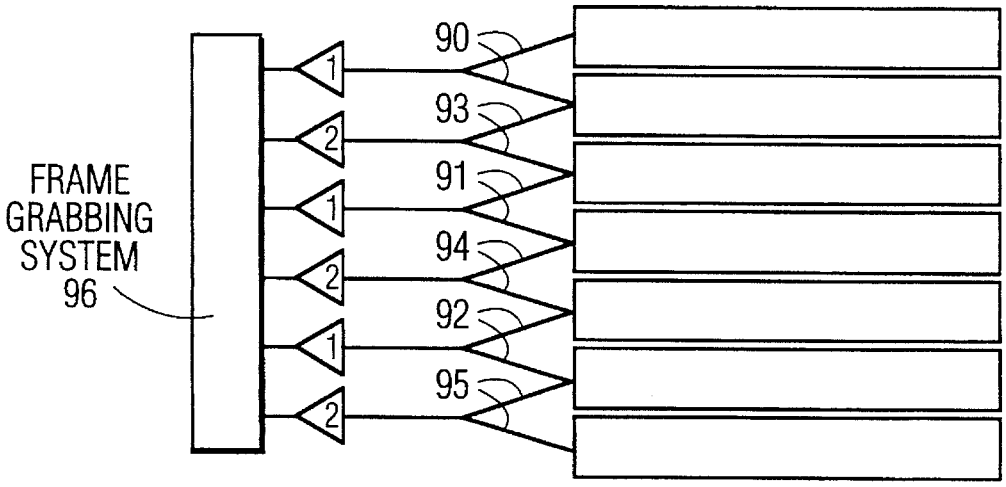

It is also applicable to the flat panel cold cathode Field Emission Sensor (FES) as shown in FIG. 9. The use of stripes offers a significant stray capacitance reduction. But in the FES configuration it also offers the ability to do parallel readout as illustrated in FIG. 9. This is accomplished because the FES approach has a multiple cathode arrangement where the individual cathode can be controlled and operated simultaneously. In such a configuration, multiple preamplifiers are connected to the Electrode pairs as indicated by the solid lines 90, 91 and 92 in FIG. 9.

The scanning proceeds as follows: The gates of the cathode are sequenced as if they were scanning lines across the stripes. Each pair begins scanning lines in the center of the top electrode. The scanning progresses downwards across the gap into the second electrode of each pair and stops in the center of the second electrode. During this scanning, all pairs are being read out in parallel through individual preamplifiers and amplifiers to a digital frame grabbing system 96. At this juncture in the scanning process, the top electrodes of each pair are electrically disconnected from each pair. The second electrode of each pair is connected to the top electrode of the pair below as indicated by the broken lines 93, 94, and 95. The scanning now continues where it was previously stopped at the middle of the bottom electrode of each pair. At this point, the entire sensor read out is complete.

The partitioned electrode arrangement may be used with any actual connection and switching mechanism for either the serial or parallel readout. The stripe output may be switched with analog switches before going to the preamplifiers. Alternatively, each stripe may have a preamplifier attached first and the switching may occur after the preamplifiers. Any combination of switching and summing amplifiers may also be used. Each stripe of each pair may go through preamplifiers to analog and to digital converters and switched digitally, for example.

The advantages of parallel readout FES approach are quite significant:

1. Significant stray capacitance reduction results in an increased dynamic range. This is especially advantageous for large area sensors. Any number of stripes can be used to achieve any desired level of stray capacitance reduction.
2. Higher bandwidth/higher speed readout is achieved.
3. FES parallel readout provides high speed and high resolution.
4. Fast readout reduces the resistivity requirements (i.e. charge storage time) of the photoconductor that would be required for high resolution, slow scan readout of a non parallel readout technique.
5. For X and Gamma ray applications, the sensors can be read out continuously during X-ray exposure to generate the signal in digital memory. For large exposures, this reduces the voltage swing on the vacuum surface resulting in resolution improvements add reducing the potential for secondary electron emission.

What is claimed is:

1. A flat panel image sensor comprising a housing including first and second surfaces, said surfaces being parallel to one another and including a vacuum therebetween, said first surface including a window for radiation, said window comprising a layer of a radiation-transparant, electrically-conducting material, a photoconductor layer positioned on the underside of said electrically-conducting layer and being electrically coupled thereto, said photoconductor layer having a surface facing said vacuum, said first surface being positioned to receive a multi-pixel radiation image, said second surface comprising an array of electron beam sources, said sensor including means for impressing a voltage on said electrically-conducting layer for establishing a bias field across said photoconductor layer, and means for activating said electron beam sources in a manner to discharge consecutive charges on said photoconductor layer corresponding to consecutive pixel positions of said image, and read cut means connected to said electrically-conducting layer for reading out the signals produced by the discharges.

2. A sensor as in claim 1 wherein said first surface includes a metallic layer transparant to X-rays.

3. A sensor as in claim 1 including a field mesh positioned in said vacuum in a plane parallel to said first and second surfaces.

4. A sensor as in claim 2 including a separate glass window for maintaining the vacuum between said first and second surfaces uniform.

5. A sensor as in claim 1 wherein said electrically-conducting material comprises tin oxide.

6. A sensor as in claim 1 wherein said electrically-conducting material comprises indium tin oxide.

7. A sensor as in claim 2 wherein said window comprises aluminum.

8. A sensor as in claim 2 wherein said window comprises beryllium.

9. A sensor as in claim 1 wherein said photoconductor layer comprises a high resistivity, electrically-insulating material which is photoconductive to incident energy photons directed at it's surface and provides charge storage in response to such photons.

10. A sensor as in claim 9 wherein said photoconductor layer is taken from a class of photoconductors consisting of thallium bromide, thallium iodide, thallium bromo-iodide, lead iodide, lead bromide, lead bromo-iodide, selenium, and composite sandwiches of the scintillating materials cesium iodide or phosphors against a light-sensitive photoconductor material.

11. A sensor as in claim 1 wherein said array of electron beams sources comprises an array of field emission tips.

12. A sensor as in claim 1 wherein said electrically-conducting layer is partitioned into stripes and said means for activating provides an electron beam in a manner to scan along the long axis of said stripes and scan said stripes in sequence for discharging consecutive areas of said photoconductor corresponding to pixels of an incident radiation image.

13. A sensor as in claim 12 wherein adjacent ones of said stripes are electrically connected in pairs to a common amplifier.

14. A sensor as in claim 13 including means for switching from a first pair of amplifiers to the next subsequent one of said pairs when said electron beam scanning along the center of a second stripe of said first pair.

15. A sensor as in claim 13 wherein said means for activating includes means for activating said electron beam sources in parallel and means for reading out said amplifiers in parallel.

16. A flat panel image sensor comprising a housing having first and second surfaces, said surfaces being parallel to one another and including a vacuum therebetween, said first surface including a window for radiation, said window comprising a layer of radiation transparant, electrically-conducting material, a photoconductor layer positioned on the underside of said electrically-conducting layer and being electrically coupled thereto, said photoconductor layer having a surface facing said vacuum, said second surface comprising an array of individual sources of an electron beam.

17. A sensor as in claim 16 also including means for impressing a voltage on said electrically-conducting layer for establishing a bias field across said photoconductor layer and means for activating said impressing means in a sequence to scan said photoconductor surface.

18. A flat panel device comprising a housing having first and second surfaces, said surfaces being parallel to one another and including a vacuum therebetween, said first surface including a window for radiation, said window comprising a layer of radiation-transparant, electrically-conducting material, a photoconductor layer positioned on the underside of said electrically-conducting layer and being electrically coupled thereto, said photoconductor layer having a surface facing said vacuum, said second surface comprising an array of sources of electrons, said layer of electrically-conducting material being partitioned into stripes, said device also including a plurality of amplifiers and means for connecting said stripes in pairs to associated ones of said amplifiers and means for reading data from said amplifiers selectively.

* * * * *